US006595201B2

(12) United States Patent
Garloch et al.

(10) Patent No.: US 6,595,201 B2
(45) Date of Patent: Jul. 22, 2003

(54) SAFEGUARD FOR FURNACE DRAFT SYSTEM

(75) Inventors: Duane David Garloch, Indianapolis, IN (US); Merle Dana Sears, Mooresville, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/976,180

(22) Filed: Oct. 12, 2001

(65) Prior Publication Data

US 2002/0048738 A1 Apr. 25, 2002

Related U.S. Application Data

(63) Continuation-in-part of application No. 09/691,418, filed on Oct. 18, 2000, now Pat. No. 6,305,369.

(51) Int. Cl.[7] ..... F24H 3/00; F23N 5/02

(52) U.S. Cl. ..... 126/116 A; 126/116 R; 431/18; 431/21

(58) Field of Search ..... 126/116 A, 116 R, 126/99 R, 110 A, 110 R, 112, 307 R, 312; 431/18, 121, 13–16, 21; 374/141, 147, 148, 208; 34/575, 606–608; 236/236, 45, 26 R, 26 A, 1 G

(56) References Cited

U.S. PATENT DOCUMENTS

| | | | | | |
|---|---|---|---|---|---|
| 3,542,018 | A | * | 11/1970 | Quick | 126/116 R |
| 4,290,552 | A | * | 9/1981 | Prikkel, III | 110/163 |
| RE30,936 | E | * | 5/1982 | Kmetz et al. | 236/1 G |
| RE31,256 | E | * | 5/1983 | Schmidt | 110/163 |
| 4,460,121 | A | * | 7/1984 | Hedrick | 236/1 G |
| 4,613,297 | A | * | 9/1986 | Zanias et al. | 126/116 A |
| 4,619,602 | A | * | 10/1986 | Grant | 236/1 G |
| 4,899,726 | A | * | 2/1990 | Waterman | 126/104 A |
| 4,951,651 | A | * | 8/1990 | Shellenberger | 126/116 A |
| 5,158,446 | A | * | 10/1992 | Hall | 122/14.1 |
| 5,368,010 | A | * | 11/1994 | Weber et al. | 126/110 R |
| 5,437,263 | A | * | 8/1995 | Ellingham et al. | 126/110 AA |
| 5,749,355 | A | * | 5/1998 | Roan et al. | 126/110 R |
| 6,021,775 | A | * | 2/2000 | Dempsey et al. | 126/103 |
| 6,053,162 | A | * | 4/2000 | Godfree et al. | 126/293 |
| 6,102,030 | A | * | 8/2000 | Brown et al. | 126/307 A |
| 6,227,191 | B1 | * | 5/2001 | Garloch | 126/110 R |

FOREIGN PATENT DOCUMENTS

| | | | | |
|---|---|---|---|---|
| DE | 3931095 A1 | * | 3/1990 | F24H/9/20 |
| DE | 29709431 U1 | * | 10/1998 | F24H/9/20 |

* cited by examiner

*Primary Examiner*—Henry Bennett
*Assistant Examiner*—Kathryn Ferko
(74) *Attorney, Agent, or Firm*—Wall Marjama & Bilinski LLP

(57) ABSTRACT

A draft safeguard apparatus for use in a multi-poised furnace having an inducer housing for receiving flue gases from a heat exchanger. The furnace flue pipe is attached to the inducer housing by an elbow that is rotatably connected to the inducer housing. An elongated sensor housing is mounted upon the elbow. The housing provides a flow channel so that the inlet section of the elbow communicates with the surrounding ambient. A limit switch is mounted in the housing to sense the temperature in the flow passing through the housing. When the furnace is operating normally, ambient air is drawn into the vent system through the sensor housing. If the vent system becomes restricted, the flow through the housing is reversed and the limit switch is opened when the reverse flow temperature exceeds a given limit. A baffle that includes a flat, rectangular-shaped top plate is mounted inside the elbow to form a chamber over the entrance to the sensor housing which directs the flue gas flow over the entrance when the vent system is unblocked and directs the flue gas flow into the gas sensor housing in the event that the vent system becomes blocked.

9 Claims, 5 Drawing Sheets

SAFEGUARD FOR FURNACE DRAFT SYSTEM

This application is a continuation in part of application Ser. No. 09/691,418, filed Oct. 18, 2000 now U.S. Pat. No. 6,305,369.

FIELD OF THE INVENTION

This invention relates generally to an apparatus for mounting a draft safeguard switch in a multi-poise furnace.

BACKGROUND OF THE INVENTION

As disclosed in the Gable et al. U.S. Pat. No. 4,401,425, control devices for shutting down gas fired furnaces in the event the flue gas venting system becomes clogged are known in the art. In the Gable et al. patent, flue gases from a collector box are moved by a fan or blower into a second discharge box and then exhausted into a vent pipe. A baffle is used to direct the flue gases from the blower to the vent pipe to create a negative pressure within the discharge box and thus provide for a natural draft in the flue system.

A draft safeguard switch (DSS) is attached to the side of the discharge box and includes a chimney-like connector through which ambient air is drawn into the discharge box during normal operations. If a pressure above ambient pressure builds up in the discharge box, because of a fault in the venting system, flue gases are forced out of the discharge box through the connector, thereby raising the temperature in the connector. A temperature sensitive switch is attached to the connector which opens when a threshold temperature is sensed which, in turn, shuts down the furnace and the fuel supply valve.

Although the DSS system described in the Gable et al. patent works well in practice, it does not lend itself readily to use in multi-poise furnaces where the furnace can be oriented in a number of different positions that require the flue pipe to be correspondingly reoriented. As noted, the system disclosed by Gable et al. includes a fixed baffle which is needed to create a negative pressure within the discharge box so that the flue gases can flow naturally into the vent system. Although many of the prior art systems operate well in practice, the overall sensitivity of the devices in detecting a restriction in the vent system of a gas fired furnace is generally lower than desired.

SUMMARY OF THE INVENTION

It is therefore an object of the present invention to improve apparatus for shutting down a furnace in the event the furnace vent becomes blocked.

It is a further object of the present invention to provide a draft safeguard system that can operate effectively in multi-poised furnaces regardless of the furnace orientation.

A still further object of the present invention is to increase the sensitivity of a draft safeguard system used in a gas fired furnace.

These and other objects of the present invention are attained by draft safeguard systems for use in a multi-poise furnace having an inducer box located at the outlet of the furnace heat exchanger. A vent pipe is attached to the inducer housing by an elbow having a linear inlet section that is rotatably connected to the inducer box and a linear outlet section connected to the vent pipe. The two linear sections of the elbow are, in turn, connected by means of a bend section. The elbow can be rotated within the collector box to different positions, depending upon the furnace's orientation. An elongated flue gas sensor housing is mounted upon one section of the elbow and contains a first opening that communicates with the flue gas flow within the elbow and a second opening that communicates with the surrounding ambient. A temperature sensing limit switch is mounted upon the sensor housing adjacent to the second opening for sensing the temperature of the flow moving through the sensor housing between the openings. Under normal furnace operations, ambient air is drawn into the inducer box through the sensor housing. In the event of a vent blockage, the flow is reversed and hot flue gases pass over the limit switch cycling the switch and shutting down the furnace.

A baffle is mounted with the elbow over the flue gas inlet to the sensor housing. The baffle establishes a chamber over the inlet that is closed at one end, that faces the flow of flue gas that enters the elbow from the inducer unit. The opposite end of the baffle is opened to a reversal of flow in the vent system in the event of a restriction in the system.

BRIEF DESCRIPTION OF THE DRAWING

For a better understanding of these and other objects of the present invention, reference will be made to the following detailed description of the invention which is to be read in connection with the accompanying drawing, wherein.

DETAILED DESCRIPTION OF THE INVENTION

Figure 1:
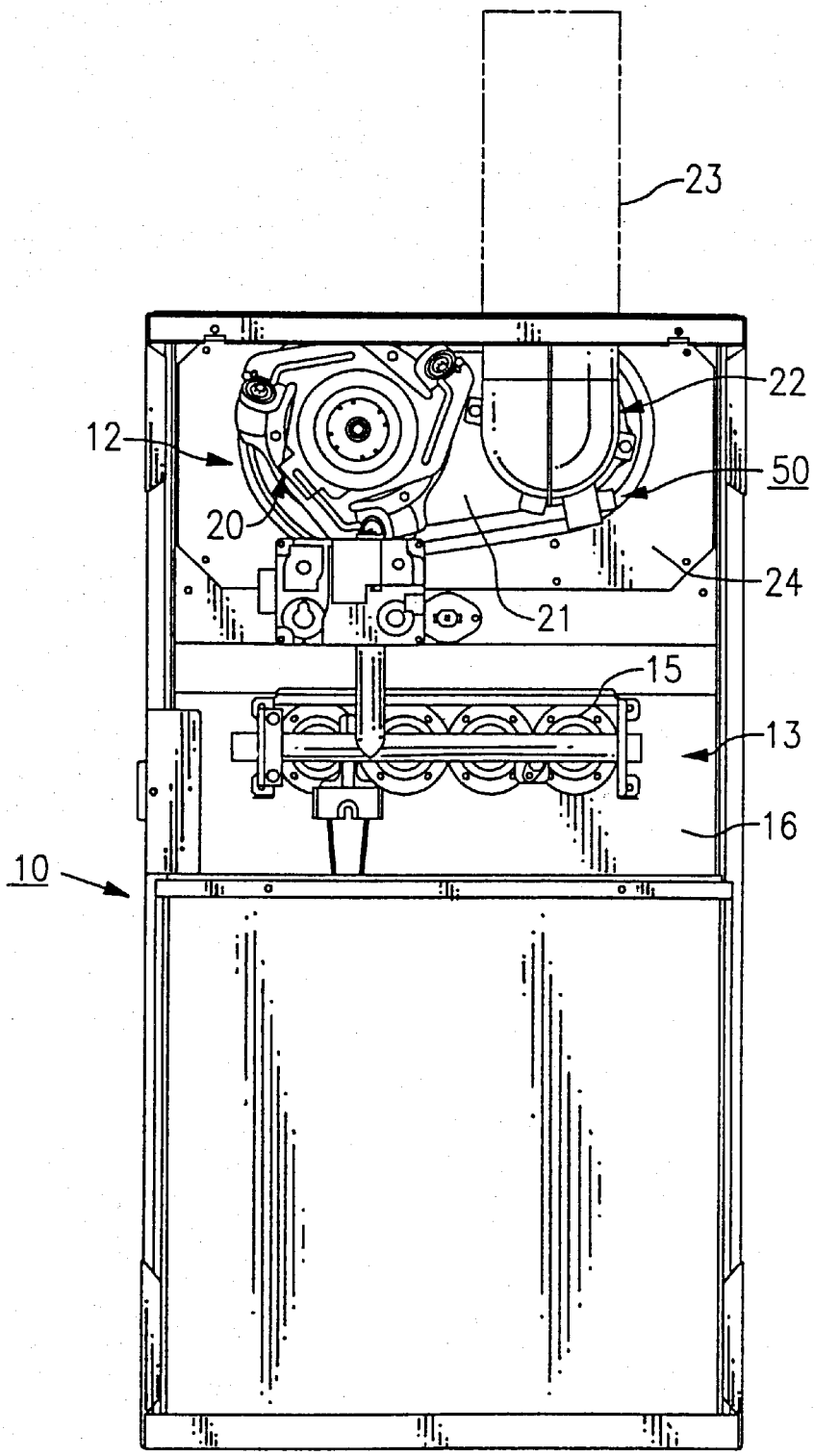
FIG. 1 is a front view of a multi-poise furnace illustrated in an upright position with the upper front covers removed to show the inducer and burner sections of the furnace.

Turning initially to FIG. 1, there is illustrated a gas fired multi-poise furnace, generally referenced 10, that contains an inducer assembly 12. The furnace is shown in an upright position wherein the return air from the comfort region enters the lower part of the furnace and passes vertically in an upward direction through a bank of heat exchangers in the upper part of the furnace prior to being returned to the comfort region. The burner assembly 13, seen in the front opening 16 of the furnace, contains four burners 15, although the furnace may contain more or less burners. Mounted directly over the burner assembly is the inducer assembly. The inducer fan motor unit 20 is secured to the front wall of the inducer housing 21, along with a vent elbow 22 that connects the inducer housing with a flue pipe 23.

Figure 2:
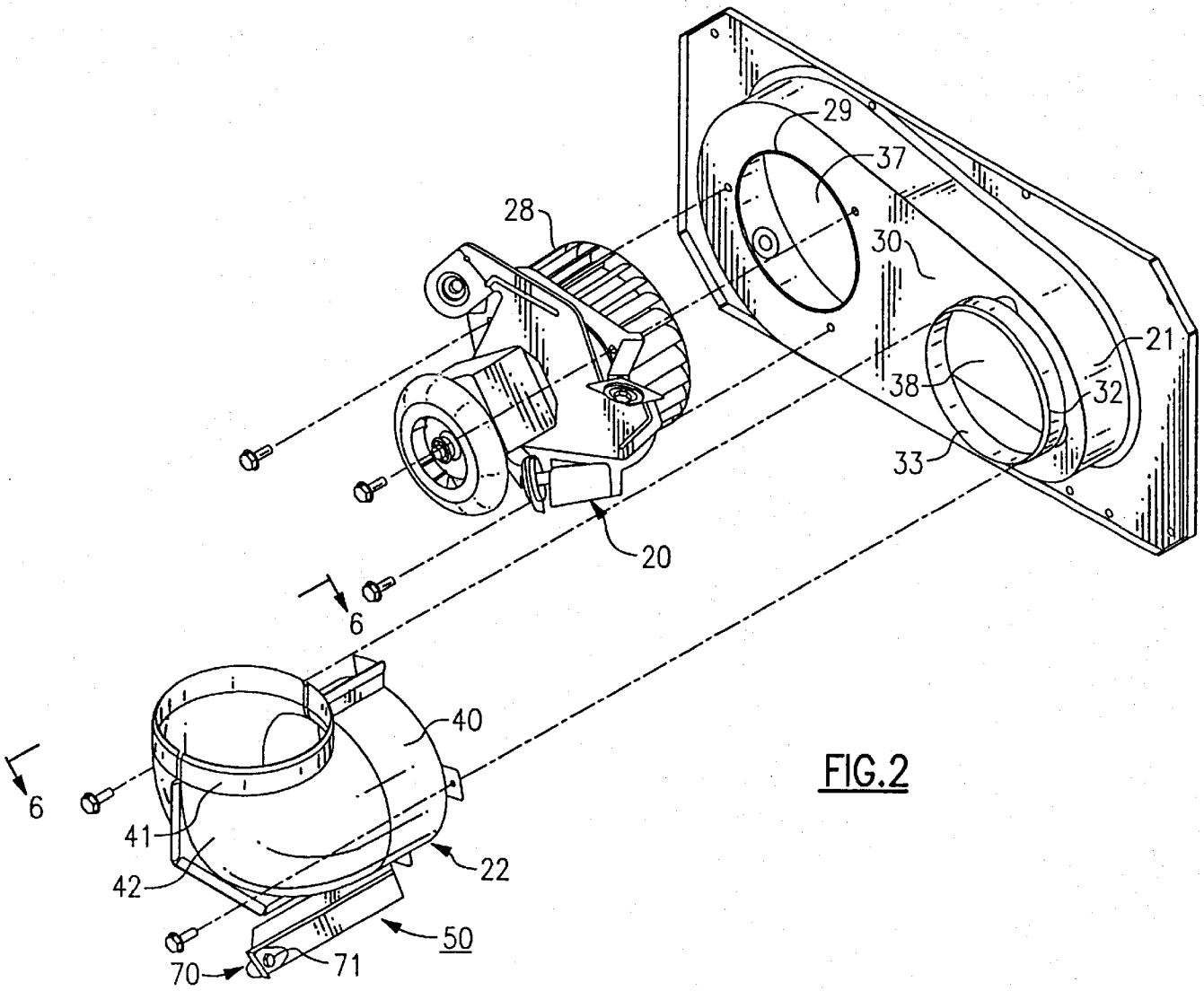
FIG. 2 is an exploded view in perspective showing the inducer box assembly of the present furnace.

The inducer assembly is shown in greater detail in FIG. 2. The unit includes the previously noted inducer housing 21 that is secured in assembly to a back wall 24 that closes against the heat exchanger discharge duct. The back wall of the inducer housing contains a generous opening (not shown) that communicates with the heat exchanger outlet. The fan motor unit includes a blower 28 which, in assembly, passes through an opening 29 formed in the front wall 30 of the inducer housing. The fan motor assembly 20 is secured to the front wall of the inducer housing over the blower opening to position the blower adjacent to and in axial alignment with the opening to the furnace heat exchange that is contained in the rear wall of the inducer housing.

The vent elbow 22 is arranged to pass over a cylindrical discharge flange 32 that surrounds a flue gas discharge opening 33 formed in the front wall of the inducer housing adjacent to the blower opening. The inducer housing is divided by a scroll into two separate chambers that are the blower chamber 37 and the discharge chamber 38. In operation, the blower fan creates a draft in the heat exchanger outlets, thereby inducing the flue gases to flow into the discharge chamber in the inducer housing and then out of the furnace via the flue pipe.

Figure 3:
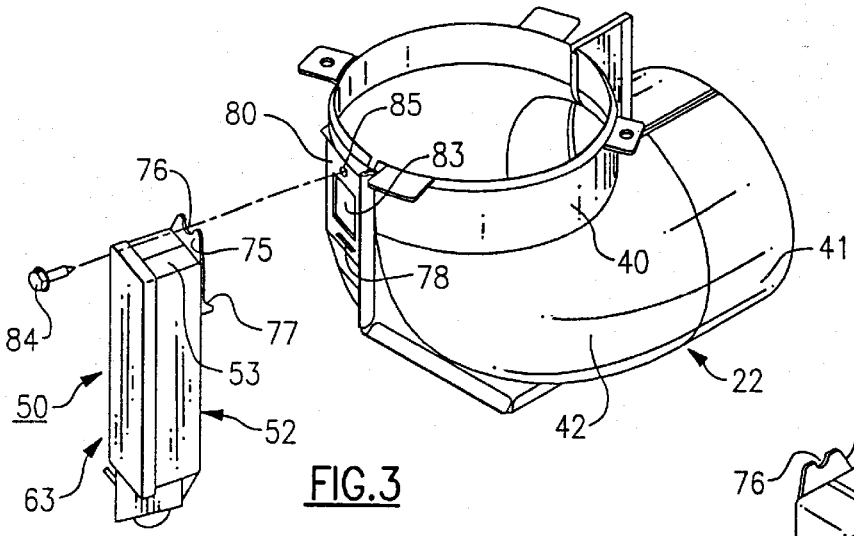
FIG. 3 is a further enlarged view in perspective showing the elbow of the vent system for connecting the inducer box to a furnace flue pipe and further illustrating the sensor housing attached to the elbow.
Figure 5:
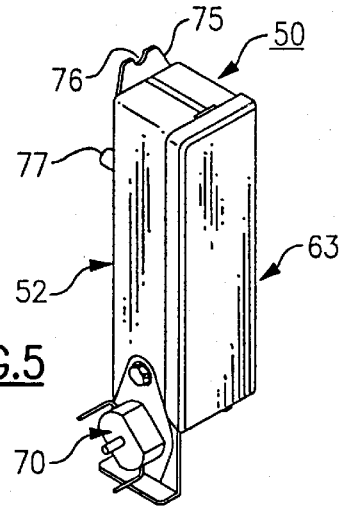
FIG. 5 is an assembly drawing, in perspective, of the flue gas sensor housing.
Figure 4:
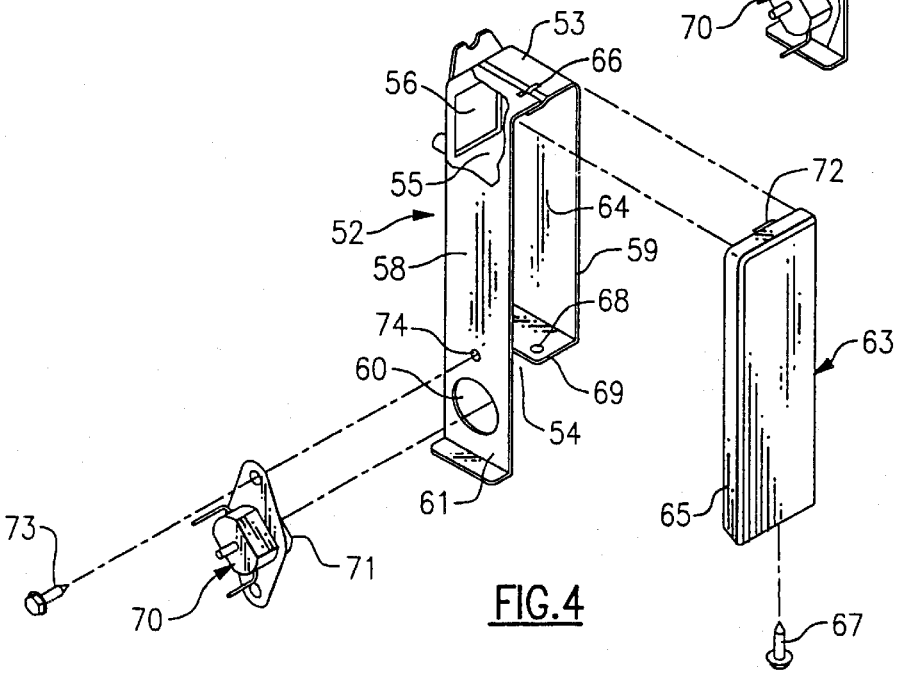
FIG. 4 is an exploded view in perspective showing the component parts of the flue gas sensor housing.

With further reference to FIGS. 3 through 5, there is shown in greater detail the apparatus of the present invention. The vent pipe elbow, generally referenced 22 includes a straight or linear inlet section 40 that is connected to the discharge flange 32 of the inducer housing so that the elbow can be rotated to various positions relating to the furnace orientation. The inlet section 40 is connected to a linear outlet section 41 by means of a bend section 42. The outlet section of the elbow, in turn, is joined to the flue pipe 23 using any well known joining techniques thereby attaching the inducer housing to the flue pipe. As illustrated, the bend section of the elbow turns through 90° of arc, however, it should be clear to one skilled in the art, that the bend of the elbow can be greater or less than 90° without departing from the teachings of the invention.

An elongated flue gas sensor housing, generally referenced 50, is secured to the inlet section of the elbow so that the housing will rotate with the elbow as the elbow is moved to different positions relating to the furnace's orientation. The sensor housing includes a three-sided body 52 that is closed at one end by an end wall 53 and is open at the opposite end 54. A first side wall 55 of the three side walls contains a rectangular shaped opening 56 at its upper end adjacent to the end wall 53. A second side wall 58 is longer than the opposing third side wall 59 of the body and contains a circular hole 60 in the extended section 61 (FIG. 4) thereof. The open side of the body is closed in assembly by a lid 63 so that the housing forms an elongated flow chamber 64 extending between the upper opening 56 and the bottom opening 54. The removable lid provides easy access to the housing during periodic servicing of the furnace. The lid contains a skirt 65 that extends about its entire periphery. The lid is provided with a tab 72 that is slidably received in a slot 66 formed in the end wall 53. A screw 67 is passed through the opposite end of the skirt as illustrated in FIG. 4 and is threaded into a hole 68 provided in a lip 69 that depends inwardly from the body side wall 59.

A normally closed temperature limit switch 70 is mounted in the extended section 61 of side wall 58. The switch contains a probe 71 (FIG. 1) that is adapted in assembly to pass through the hole 60 contained in the extended section of side wall 58. The limit switch is secured to the extended section by a screw 73 that is threaded into a hole 74 provided in the extended section of side wall 58 so that the probe will be exposed to a flow of gas or air passing into or out of the housing through the adjacent open end 54 of the housing. As will be explained below, the limit is adapted to sense the temperature in the flow stream and cycle open in the event the temperature exceeds a given value thereby shutting down the furnace.

The side wall 55 of the body section 52 protrudes outwardly beyond the end wall 53 to form a rib 75. The protruding rib 75 of the wall contains a semi-circular slot 76 formed therein. As best seen in FIG. 3, an outwardly extended tab 77 is mounted immediately beneath the opening 56 in side wall 55 and is arranged to be hooked through slot 78 in the flat rectangular shaped mounted pad 80 contained on the inlet section 40 of the vent elbow 22. The mounting pd surrounds a clear rectangular shaped opening or window 83 that passes through the inlet section. In assembly, with the tab inserted in the slot 78, and the sensor housing is secured to the pad using a screw 84 that is passed through the semi-circular slot 76 of rib 75 and is threaded into hole 85 provided in the mounting pad. When the housing is secured to the elbow, the upper opening 56 in the housing is aligned with the window 83 in the elbow. Accordingly, gas or air can flow in either direction between the two openings in the housing between the surrounding ambient and the inducer housing.

Due to the flue gas temperature and the flue gas velocity in the inducer housing, the linear inlet section 40 of the vent elbow 22 is placed under a negative pressure when the furnace is operating normally. In the event the vent system becomes restricted, the pressure in the elbow will increase. The elbow thus provides an ideal place to mount the safeguard limit switch 70 and thus eliminate the need of a baffle plate or the like in the inducer to create the necessary pressure differences to establish a natural flow through the vent system.

As noted above, the sensor housing is connected directly to the elbow and gas can be exchanged between the housing and the elbow through the coaligned opening 56 and window 83. During normal furnace operations, ambient air is drawn into the sampling tube due to the negative pressure that is seen by the inlet section of the elbow and is passed into the vent system. The air flow is relatively low and thus will not adversely effect the furnace operation. The temperature sensed by the safeguard switch 70, in turn, at this time, is relatively low and the switch, which is normally closed, will remain closed to maintain the furnace in operation. In the event the vent system becomes restricted, the pressure at the inlet to the elbow increases and the flow through the sensor housing is reversed whereupon hot flue gases from the vent system flow outwardly through the housing to the surrounding ambient. The hot flue gases leaving the housing pass over the sensor probe and the switch is opened when a given threshold temperature is exceeded thereby shutting down the furnace.

Figure 6:
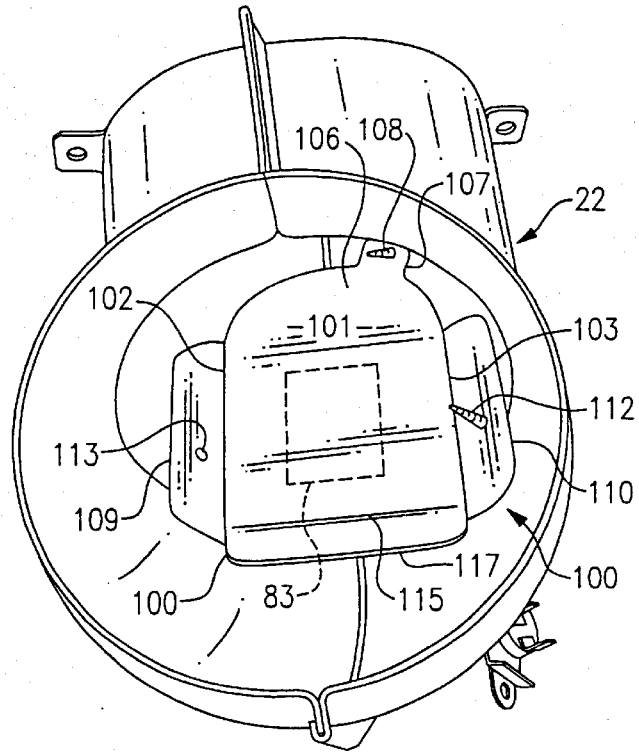
FIG. 6 is an enlarged end view taken along lines 6—6 in FIG. 2 looking into one end of the elbow.
Figure 7:
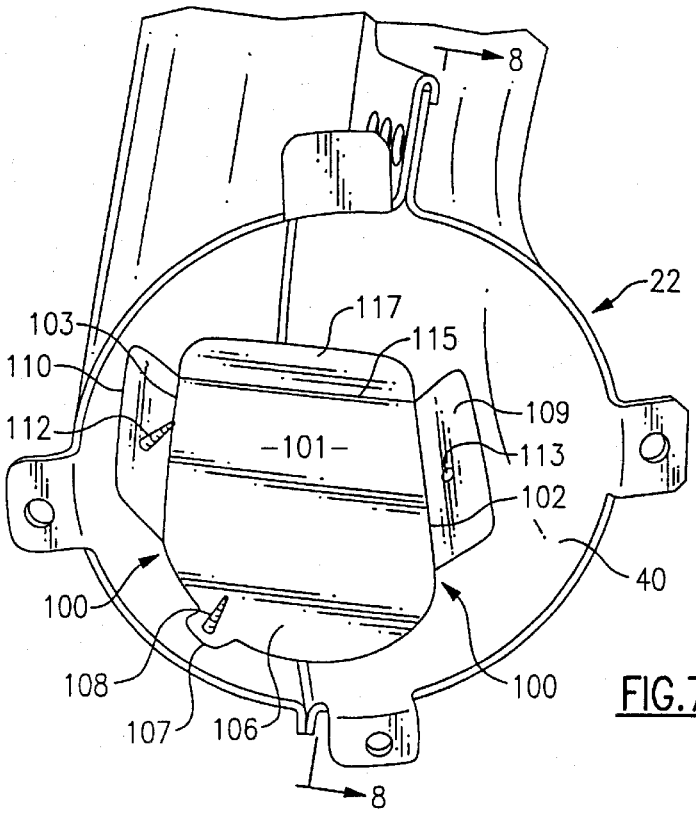
FIG. 7 is a view similar to FIG. 6 looking into the opposite end of the elbow.
Figure 8:
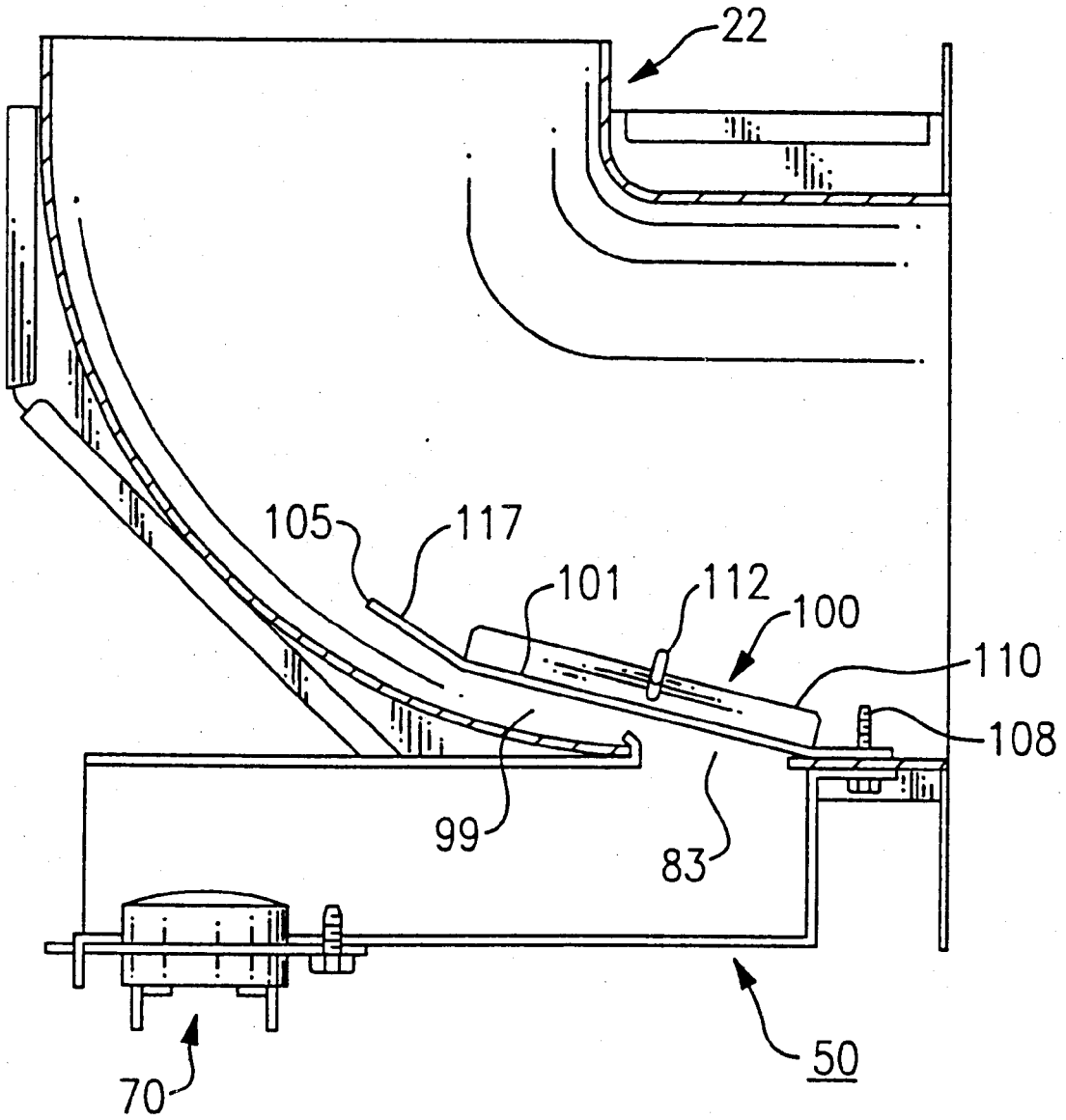
FIG. 8 is a sectional view taken along lines 8—8 in FIG. 7.

Turning now to FIGS. 6–8, there is illustrated a baffle generally referenced 100, that is mounted inside the vent elbow 22 that connects the inducer unit to the flue pipe 23 to establish a chamber 99 over the window 83 (FIG. 6). As noted above, the elbow is adapted to attach to the inducer unit in at least three different orientations, depending on the vent orientation with respect to the multi poised furnace application. As will be explained in further detail below, due to the flue gas temperature and the velocity of the gas flow, the section of the elbow is under a negative pressure with relation to the region in which the elbow entrance is located during normal operation of the furnace. In the event the vent system becomes restricted, the gas pressure in the elbow will correspondingly increase. Accordingly, as noted above, this is an ideal location to place the window opening 83 of the elbow that communicates with the interior of the sensor housing 50.

The sensor housing communicates with the elbow so that ambient air will flow through the housing at the elbow beneath the baffle 100 and will be drawn from beneath the baffle into the gas flow and vented to the outside under normal furnace operation. As best illustrated in FIG. 6 and 7, the baffle 100 includes a rectangular shaped flat top plate 101 that is placed over the window 83 provided in the circular elbow so that the side edges 102 and 103 rest in contact against the inner wall surface of the elbow on either side of the window. As further illustrated in FIG. 8, one end edge 105 of the top plate which will be referred to as the leading edge of the baffle with respect to normal gas flow through the elbow, contains a contoured integral back wall 106 that conforms to the shape of the elbow inner wall at the inlet section 40 of the elbow. The back wall thus closes the area beneath the baffle to the incoming flow of flue gas entering the elbow from the inducer unit. The back wall of the baffle is provided with a tab 107 and a screw 108 is threaded through the elbow and the tab to secure the back wall against the inner wall of the elbow.

The two opposed side edges 102 and 103 of the top plates are also provided with integral tabs 109 and 110, respectively. The side tabs are turned upwardly and conform to the inner wall contour of the elbow. Screws such as screw 112 are threaded into aligned holes, such as hole 113, in the tabs and the elbow to further secure the baffle in place over the window 83. The trailing edge 115 of the top plate is provided with an upturned lip 117 that directs the normal gas flow entering the vent system away from the open end of the baffle.

In the event that the flow of flue gas through the vent system becomes restricted, a back flow of flue gas is produced in the elbow which forces gas through the open end of the baffle and into the sensor housing, thus reversing the flow through the housing causing the temperature-sensitive switch 70 to cycle, shutting down the furnace.

The use of the baffle arrangement will enable the present system to detect lower vent static pressures when compared to systems presently used in most gas furnaces. In addition, the present baffle arrangement shields the sensor housing from the heat that is generated within the venting system to keep the sensor housing relatively cool during normal furnace operation. Lastly, the baffle arrangement provides for a more consistent sensor housing pressure when the elbow is turned to the various available vent configurations.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A draft safeguard for use in a multi-poised furnace having an inducer unit for receiving flue gas from a furnace heat exchanger and conducting the gas into a entrance of a vent system, said draft safeguard including:

a section of flue pipe in the vent system passing out of said inducer unit, said section having a circular cross section and a window located adjacent to the entrance of the vent system;

an elongated gas sensor housing mounted upon said flue pipe section, said housing having a first opening that communicates with the flue pipe section through said window and a spaced apart second opening that communicates with a surrounding ambient whereby ambient air is drawn into the flue pipe section when the vent is unblocked;

a baffle mounted inside the flue pipe system having a rectangular top plate that forms a chamber over said window so that a flow of flue gas is directed over the chamber when the vent system is unblocked and a flow of flue gas is directed into the chamber when the vent system is blocked, whereby the flue gas flow passes to ambient through said sensor housing, and a flue gas sensitive switch mounted in said sensor housing for sensing the presence of flue gas moving through said housing and providing an output signal for inactivating said furnace when the presence of flue gas is detected.

2. The draft safeguard of claim 1 wherein said top plate further includes a top plate, a pair of side edges that rest in contact with inner walls of said flue pipe section.

3. The draft safeguard of claim 2 that further includes opposed tabs, each extending along one of the side edges of the top plate, said side edges conforming to the contour of the flue pipe section and fastening means for securing the tabs to the flue pipe section.

4. The draft safeguard of claim 3 wherein said fastening means further includes threaded fasteners.

5. The draft safeguard of claim 3 wherein said top plate further includes an end wall that faces the entrance to said vent system for closing one end of said chamber.

6. The draft safeguard of claim 5 wherein said end wall further includes an end wall tab and means for securing the tab to the flue pipe section.

7. The draft safeguard of claim 6 that further includes an upraised lip extending across the top plate adjacent to an open end of said chamber.

8. The draft safeguard of claim 1 whereby said flue pipe section is an elbow.

9. The draft safeguard of claim 8 wherein said elbow is rotatably mounted within the inducer unit at the entrance to the vent system.

* * * * *